United States Patent [19]

Bendoni et al.

[11] 4,200,383

[45] Apr. 29, 1980

[54] TRANSPARENCY FILM PROCESSOR

[75] Inventors: Leonard V. Bendoni, Framingham, Mass.; Richard V. Fischer, West Warwick, R.I.

[73] Assignee: Polaroid Corporation, Cambridge, Mass.

[21] Appl. No.: 969,996

[22] Filed: Dec. 15, 1978

[51] Int. Cl.[2] ..... G03D 9/02

[52] U.S. Cl. ..... 354/304; 354/211; 354/298; 354/314

[58] Field of Search ..... 354/83, 84, 85, 86, 354/87, 211, 298, 301, 302, 303, 304, 305, 307, 311, 312, 313, 314

[56] References Cited

U.S. PATENT DOCUMENTS

| | | | |
|---|---|---|---|
| 2,638,828 | 5/1953 | Bachelder et al. | 354/312 |
| 2,804,811 | 9/1957 | Fairbank et al. | 354/87 |
| 2,835,179 | 5/1958 | Fairbank | 355/100 |
| 3,103,866 | 9/1963 | Budde | 355/107 |
| 3,650,188 | 3/1972 | Whall | 354/187 |
| 3,667,361 | 6/1972 | Meggs et al. | 354/318 |
| 3,815,971 | 7/1974 | Land | 354/314 |
| 3,854,812 | 12/1974 | Sorli | 354/301 |
| 3,896,469 | 7/1975 | Mather | 354/86 |
| 4,019,194 | 4/1977 | Cutler | 354/312 |
| 4,145,133 | 3/1979 | Wareham | 354/83 |

*Primary Examiner*—L. T. Hix
*Assistant Examiner*—Alan Mathews
*Attorney, Agent, or Firm*—Alfred E. Corrigan

[57] ABSTRACT

A small, compact apparatus for processing individual rolls of an exposed composite self-developing transparency film structure. The apparatus includes two housings pivotally connected at one end to each other for movement from a film cassette loading position to a film processing position. The other end of each housing includes a recess for receiving the open end of a lighttight, linearly extendable chamber. Mounted within the housings is a pair of motor driven elongate rollers for spreading a processing liquid across the film to initiate the formation of visible images therein while simultaneously advancing the film from its cassette and into the lighttight chamber. The two housings and the open end of the chamber carry elements which, when the chamber is coupled in lighttight relation to the housings, function as a closed electrical switch located in series with the motor, thereby insuring that the film can be processed only when the lighttight chamber is properly coupled to the housings.

6 Claims, 6 Drawing Figures

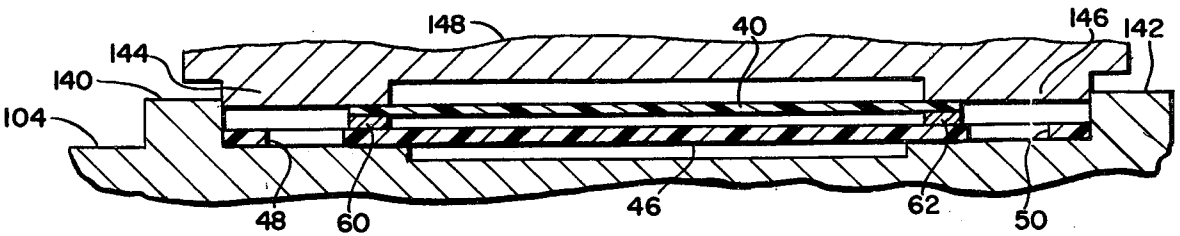
FIG. 3
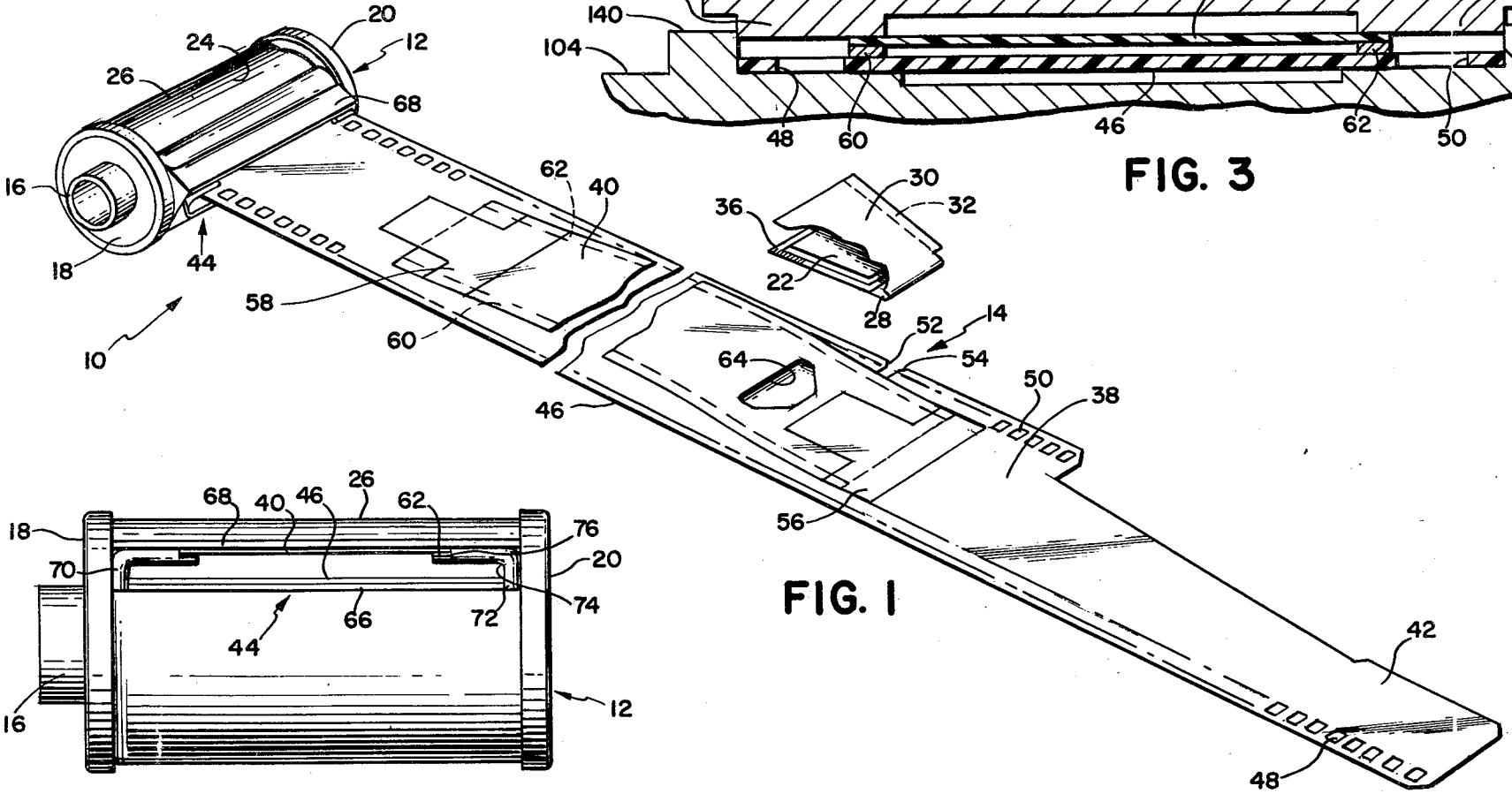
FIG. 1
FIG. 2

TRANSPARENCY FILM PROCESSOR

RELATED APPLICATIONS

This application is related to application Ser. No. 969,997 entitled "Photographic Film Assemblage," filed on even date herewith by R. Fischer. This application also relates to an improvement over the processing apparatus disclosed in application Ser. No. 818,410, filed July 25, 1977 by Richard R. Wareham and entitled "Film Assemblage of the Self-Developing Type Together with Apparatus for Processing Thereof," now U.S. Pat. No. 4,145,133.

BACKGROUND OF THE INVENTION

1. Field of the Invention

This invention relates to apparatus for processing individual rolls of an exposed composite self-developing transparency film structure.

2. Description of the Prior Art

Apparatus for processing film of the self-developing type are generally well known. There are table top processors such as shown in U.S. Pat. Nos. 3,103,865 and 2,835,179 which are basically document copying apparatus wherein an original is inserted into the apparatus so as to be moved into superposed engagement with a photosensitive sheet. The superposed elements are then exposed to a light source so as to record a latent image of the document upon the photosensitive sheet. The two are then separated with the exposed photosensitive sheet being moved into superposition with an image receiving sheet. The photosensitive and image receiving sheets are then moved into the bite of a pair of rotating rollers which spread a processing liquid between the superposed sheets to initiate the formation of a visible image in the image receiving sheet while simultaneously advancing the sheets into a dark chamber. The sheets are allowed to remain in the dark chamber until the processing has advanced to the stage where they are no longer sensitive to light and thus may be removed from the chamber and peeled apart. In some apparatus, e.g., the apparatus disclosed in U.S. Pat. No. 2,835,179, the door to the dark chamber is locked until this stage is reached. The processor may be a part of a camera such as disclosed in U.S. Pat. No. 3,650,188. In this patent the dark chamber is moved to an extended position wherein a switch is closed thereby enabling the subsequent exposure and processing of a film unit. Further, the processor may be part of a film cassette such as shown in U.S. Pat. Nos. 3,815,971 and 3,667,361. U.S. Pat. No. 3,667,361 shows a film cassette wherein "slide film" is exposed and then treated with a liquid containing a developer and a fixer to produce a visible image therein. In U.S. Pat. No. 3,815,971 the self-developing type movie film is exposed in a motion picture camera and then the film cassette is put in a motion picture projector for processing.

While the above processors perform their tasks well, they do not readily lend themselves to the processing of an exposed roll of self-developing transparency film of the type adapted for use in a conventional, i.e., nonself-developing type camera. The processor should be able to receive the cylindrical film cassette containing the exposed roll of film in such a manner that the free end of the exposed strip of film may be easily and quickly positioned relative to the various components of the processor. Further, the processor should preferably be an independent unit rather than a part of a camera, projector, document copier, etc., thereby keeping its cost to a minimum.

SUMMARY OF THE INVENTION

The instant invention relates to a film processor, and more particularly to one especially adapted for use with a novel film assemblage of the type adapted for use in a conventional 35 mm camera.

The novel film assemblage includes a generally cylindrical film cassette having a light sealed opening, a spool rotatably supported within the film cassette, a container of processing liquid, and a composite film structure including a roll of self-developing or instant type film, preferably of the type shown and described in U.S. Pat. No. 3,894,871, and a superposed cover sheet. The cylindrical film cassette is provided with a recess in its outer surface for receiving the pod of processing liquid. The depth of the recess is at least equal to the thickness of the container of processing liquid, and preferably is equal to the thickness of the pod thereby maximizing the volume of the container. The composite film structure includes a first sheet of photosensitive material having a first end secured to the spool, an intermediate section having a given length sufficient to accommodate the sequential recording thereon of a plurality of discrete subject images, preferably ten, and a second end which is adapted to extend through the light sealed opening. A plurality of sprocket holes are provided along the longitudinal margins of the first sheet for cooperating with a sprocket wheel in a camera to unwind the composite film structure during exposure of the given length. The composite film structure includes a second transparent sheet secured to the first sheet at opposite ends of the given length. The second sheet is specifically structured to function as a means for facilitating the spreading of the contents of the container of processing liquid between the two sheets and includes a pair of longitudinally extending, laterally spaced opaque rails for determining the thickness of the layer of processing liquid.

After the given length of film has been exposed in a conventional 35 mm camera, the composite film structure is rewound upon the spool until only the second end of the first sheet is located exteriorly of the cylindrical film cassette. The film cassette is subsequently removed from the camera and the container of processing liquid is removed from the recess in the exterior surface of the film cassette. The film cassette is then placed within the processor of the instant invention and the container of processing liquid is attached to the second sheet such that the discharge end of the container is located between the first and second sheets.

The processor includes first and second elongate housings pivotally connected to one another at one end thereof for movement between an open, film cassette loading position and a closed, film processing position in which they provide an environment which is free from light that would be actinic to the film being processed. The first housing includes a first recess, first and second light emitting diodes (LEDs), a motor driven spread roller, a first film cutting blade, and a second recess for receiving one half of a flange located at the open end of a linearly extendable lighttight chamber. The first housing further includes a motor and a chamber for receiving four AA batteries.

The second housing includes a recess which cooperates with the first recess to define a chamber for housing the cylindrical film cassette, and first and second diode detectors which are adapted to overlie the first and second LEDs when the housings are in the closed position. The second housing also includes a spread roller, a second film cutting blade and a recess for receiving the other half of the flange on the lighttight chamber.

The flange on the open end of the lighttight chamber includes a strip of electrically conductive material which is structured so as to connect two electrical contacts when the flange is located within the recesses in the first and second housings and the latter are latched in the closed film processing position. The two contacts and the strip of material function as a switch in series with the motor to insure that the lighttight chamber is located in position before the motor can be energized. Further, the first and second diode detectors each control a switch located in series with each other and with the above described series switch and the motor.

After the film cassette has been positioned within the first recess in the first housing, the second end of the first sheet is placed such that it extends over the two LEDs, the motor driven roller, the first film cutting blade and then through the opening in the dark or lighttight chamber. The second housing is then latched in the closed position thereby locating the two diode detectors in superposed alignment with their respective LEDs, and the roller and second film cutting blade in operative alignment with their respective counterparts. With the container of processing liquid located between the two sheets and between the second LED and its respective detector, the latter cannot "see" the former when the processor's start button is actuated. Also, one of the opaque rails on the second sheet is located between the first LED and its detector such that the latter cannot "see" the former. The start button is actuated and, because the dark chamber is properly located in lighttight relation with the two housings and the detectors cannot see the light being directed at them by the LEDs, the motor is energized since all switches located in series therewith are closed. Acutation of the button also starts a timing circuit which terminates after the film has been processed to a stage where it may be exposed to the ambient light. The superposed rollers drive the composite film structure from the film cassette and into the dark chamber while simultaneously rupturing the container of processing liquid and spreading its contents between the first and second sheets to initiate the formation of visible images within the first sheet. After the given length of the first sheet has been driven through the rollers, the opaque rails terminate thereby enabling the detector to "see" the illumination of the first LED. The detector then opens its switch located in series with the motor thereby stopping the latter. When the timing circuit ends the second housing may be moved to the open position and the film removed from the dark chamber. Prior to opening the processor the second cutting blade may be actuated by an exteriorly located handle to bring it into cutting relation with the first cutting blade or anvil to thereby sever the processed film from the remainder of the roll of film. To insure the proper cutting position of the two blades relative to each other, means are provided for automatically positioning the first blade relative to the second blade.

An object of the invention is to provide an apparatus for processing individual rolls of self-developing transparency film with means for automatically terminating the advancement of the film from a film cassette and into a dark chamber after a predetermined length of the film has been processed.

Another object of the invention is to provide an apparatus of the type set forth above with means for automatically adjusting the position of a pair of film cutting blades relative to each other.

Still another object of the invention is to provide an apparatus of the type described with a linearly extendible dark chamber which includes means for insuring that a processing cycle cannot be started until after the dark chamber has been properly coupled to the remainder of the apparatus.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein:

FIG. 1 is a perspective view of a photographic film assemblage showing an elongate composite film structure partially withdrawn from a cylindrical film cassette and a container of processing liquid spaced from its operative position relative to the composite film structure;

FIG. 2 is an enlarged elevational view of the cylindrical cassette shown in FIG. 1;

FIG. 3 is an enlarged cross-sectional view of the elongate composite film structure located between the edge controls of the processor of the instant invention;

DETAILED DESCRIPTION OF THE INVENTION

Figure 4:
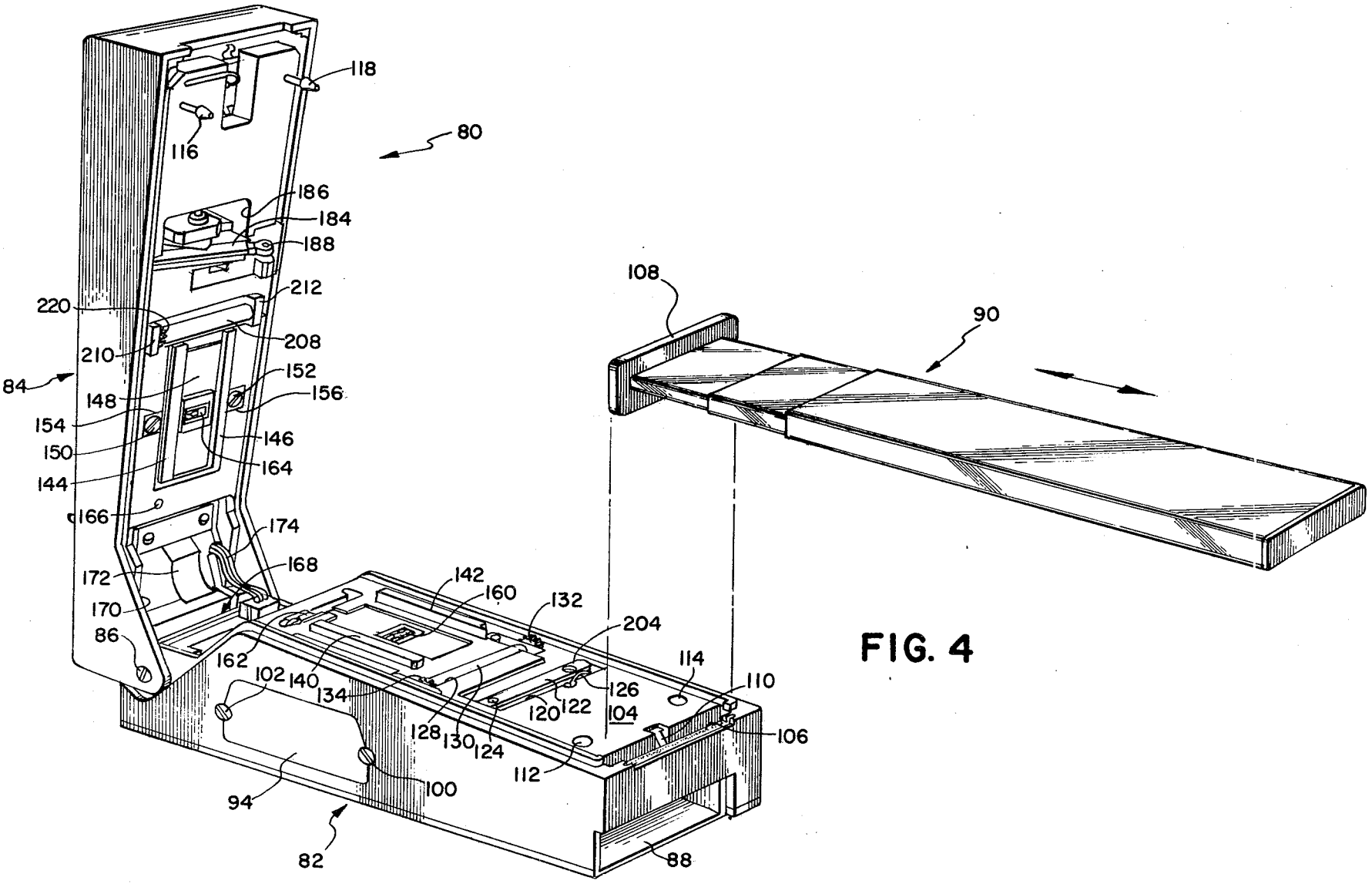
FIG. 4 is a perspective view of the processor including an extensible dark chamber for use in processing the composite film structure.

Reference is now made to FIG. 1 of the drawings wherein is shown a photographic film assemblage 10 especially adapted for use in conventional, noninstant type 35 mm cameras. The film assemblage 10 includes a film cassette 12 having a generally cylindrical configuration, an elongate composite film structure 14, a spool 16 rotatably supported within apertures in the end walls 18 and 20 of the cassette 12, and a container 22 of processing liquid.

The cylindrical film cassette 12 is provided with a recess 24 in its exterior surface for storing the container 22 of processing liquid until it is needed for the processing of the elongate composite film structure 14. The container 22 is originally located within the recess 24 such that its long or longitudinal measurement runs parallel with the axis of rotation of the spool 16 and its short or lateral measurement is maintained in a large radius arc which closely conforms with the circumference of the main body 26 of the film cassette 12. The depth of the recess 24 is substantially equal to the thickness of the container 22. Attached to one longitudinal end 28 of the container 22 is a member 30 having adhesive strips 32 running along longitudinal edges thereof. When the container 22 is located within the recess 24, the member 30 overlies the container 22 and is releasably secured to opposite sides of the recess 24 by the adhesive strips 32 thereby maintaining the gentle bend in the container in conformance to the curving contour of the main body 26. So located, the general overall configuration of the film assemblage 10 closely approximates that of the conventional film cassette presently used in noninstant 35 mm cameras, e.g., a Minox 35 EL manufactured by Minox GmbH of Giessen 1, West Germany. Accordingly, the film cassette 12 may be easily substituted for the conventional cassette thereby releasing the conventional 35 mm camera from its restraint to use with only conventional film, i.e., nonself-developing type film.

The positioning of the container 22 of processing liquid in the external recess 24 of the film cassette 12 offers many advantages in comparison to locating it within the film cassette. One advantage is that since the normally flat container 22 need only be wrapped around a curved surface having a relatively large radius when it is located within the recess 24, it can hold a much greater volume of processing liquid as compared with a container located within the film cassette which would have to be wrapped around a surface having a shorter radius. One reason for this is that the bending or curving of the walls of the container 22 generally result in an increase in the pressure of the processing liquid. If the pressure builds to a point above that needed to rupture the sealed end 36 of the container 22, the processing liquid will be prematurely released from the container 22. Another advantage in locating the container 22 in the external surface of the film cassette is that it provides more latitude in when the container 22 can be added to the assemblage 10 during the assembly thereof. Still further, if, during a quality control test on the assembly line, the processing liquid within the container is found to be not compatible with the composite film structure located within the film cassette, it, the container, may be readily replaced by one containing the correct processing liquid without opening the film cassette and possibly fogging the composite film structure. However, if the container were located within the film cassette care must be taken not to expose the composite film structure during such exchange of containers.

The composite film structure 14 includes first and second sheets 38 and 40, respectively. The first sheet is a self-developing or instant type film, preferably of the type shown and described in U.S. Pat. No. 3,894,871. The first sheet 38 includes a first end (not shown) which is attached to the spool 16, a second end 42 which is adapted to extend through a light sealed opening 44 in the film cassette 12 so as to be connectable with a take-up sprocket wheel in a camera, and an intermediate portion 46 of a given length extending between the first and second ends upon which a plurality of discrete subject images are adapted to be sequentially recorded. Each lateral side of the first sheet 38 is provided with a row 48 and 50 of apertures which are adapted to receive the sprockets of a sprocket wheel in a camera for withdrawing the major portion of the elongate composite film structure 14 from the film cassette 12. The row 50 is provided with a recessed edge section 52 for preventing the second end 42 from being wound into the film cassette 12. In effect, when the row 50 is notched, as at 52, the corner 54 of the sheet 38 has a natural tendency to misalign itself with the exit slot 44 during rewinding of the elongate composite film structure 14 into the film cassette 12.

The second sheet 40 is formed from any suitable transparent material and is suitably attached at its ends to the first sheet 38 by adhesive tapes 56 and 58. A pair of opaque longitudinally extending, laterally spaced rails 60 and 62 are secured to the underside of the second sheet 40 so as to provide a minimum spacing between the second sheet 40 and the intermediate portion 46 of the first sheet 38 during the spreading of processing liquid therebetween. The rails 60 and 62 also function during the spreading operation to prevent the processing liquid from leaking at the longitudinal edges of the second sheet. The second sheet 40 is also provided with an aperture 64 which is adapted to receive the container 22 just prior to the processing of the composite film structure. The container 22 is inserted into the aperture 64, discharge end 36 first, such that the container 22 lies between the second sheet 40 and the intermediate section 46 with the discharge end 36 facing the film cassette 12; and the member 30 lies on the upper surface of the second sheet 40 in superposed relation to the container 22. The adhesive strips 32 adhere to the upper surface of the second sheet so as to maintain the container 22 in position. At this point, it should be noted that the length of the second sheet 40 is greater than the length of the intermediate portion 46 which it overlies so as to compensate for the added distance that it, as the outer layer in a convolution, must travel relative to the underlying intermediate portion 46.

The first and second sheets 38 and 40 are maintained in proper alignment with each other during the winding and unwinding of the elongate composite film structure 14 about the reel 16 by a guide means located immediately adjacent the light sealed opening 44 in the film cassette 12. The opening 44 is defined in part by a pair of outwardly extending parallel flanges 66 and 68. A pair of guides 70 and 72 extend upwardly from the flange 66 and then inwardly toward each other. Each guide includes a first recessed portion 74 and a second recessed portion 76. The horizontal distance between the first recessed portions 74 is approximately equal to the width of the intermediate portion 46 of the first sheet 38 and the horizontal distance between the second recessed portions 76 is approximately equal to the width of the second sheet 40.

The film assemblage 10 is loaded into a conventional 35 mm camera and the second end 42 of the elongate composite film structure 14 is attached to the sprockets of the camera's sprocket wheel. The camera's film loading door is closed and the sprocket wheel is rotated to advance the elongate composite film structure 14 from the film cassette 12 until the first frame of the intermediate section 46 is located in position for exposure. The film is exposed with the lower surface (as viewed in FIG. 3) of the intermediate section facing the objective lens. After exposure, the remaining frames are sequentially advanced into their exposure position until all of the given length of the intermediate section 46 has been exposed. The user then rotates a film rewinding knob to rewind the elongate composite film structure 14 on the spool 16, the rewinding operation terminating when the user feels the increased tension on the knob caused by the corner 54 of the first sheet 38 getting hung up on one of the flanges 66 and 68 at the light sealed opening 44. The film assemblage 10 is then removed from the camera and placed in a small compact easy to use processor 80 for immediate processing of the latent images in the given length of the intermediate section 46, i.e., the length between the points of attachment of the second sheet 40 to the first sheet 38.

Figure 5:
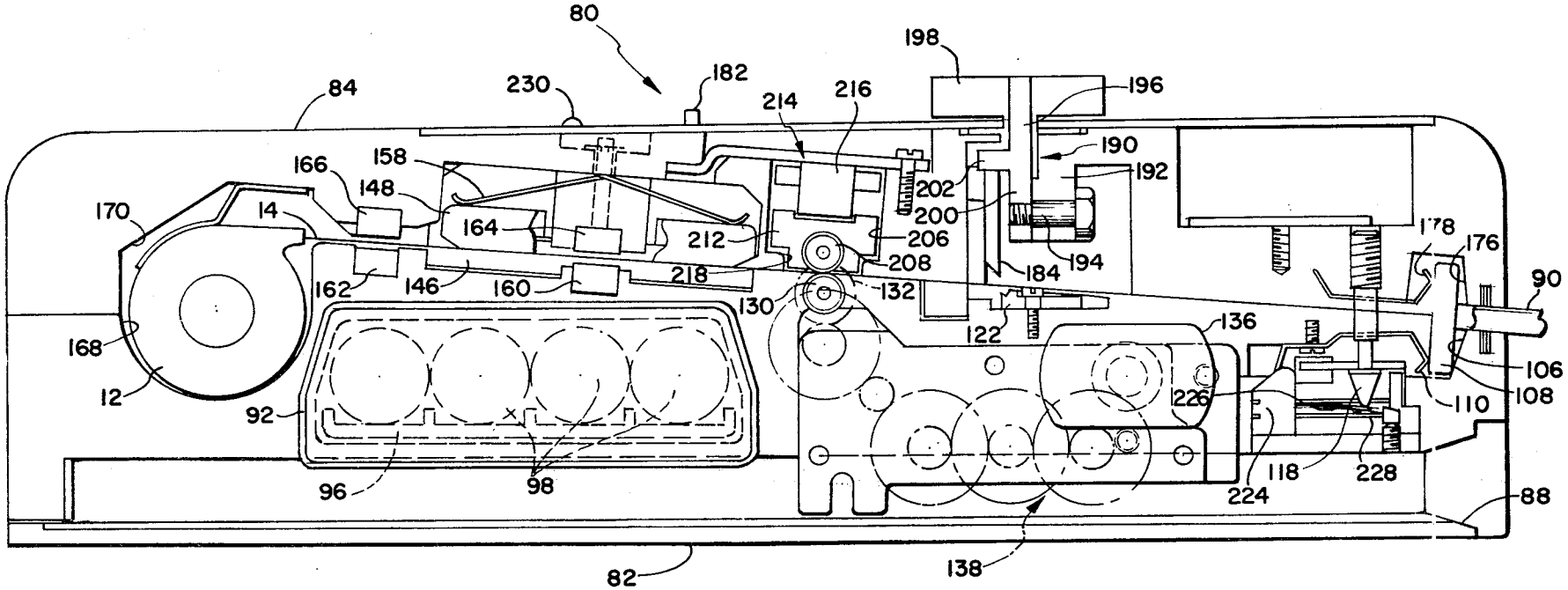
FIG. 5 is a side elevational view, with portions removed, of the processor of FIG. 4.

The processor 80 includes first and second housings 82 and 84 pivotally connected at 86 to each other for movement between an inoperative, film loading position, as shown in FIG. 4, and an operative film processing position, as shown in FIG. 5 wherein they form a lighttight enclosure for the composite film structure 14. The first housing 82 includes an elongate recess 88 for storing an extendible dark chamber 90 and a battery compartment 92 for slidably receiving a battery tray 94. The battery tray 94 includes a horizontal support 96 (see FIG. 5) for receiving a plurality of batteries 98. The tray 94 is secured in place by any suitable means such as by the heads of a pair of screws 100 and 102. A top wall 104 of the first housing 82 includes a recess 106 for receiving the bottom half of a flange 108 located at the open end of the dark chamber 90. Mounted within the recess 106 is an electrical contact 110 which forms one part of a switch to be described later. A pair of holes 112 and 114 are located adjacent to the recess 106 for receiving a pair of latch pins 116 and 118, respectively, located on the second housing 84. Suitable means are located within each hole 112 and 114 for releasably locking onto the enlarged head portions of the pins 116 and 118 when the housings 82 and 84 are in the position shown in FIG. 5. The surface 104 is provided with a second recess 120 for receiving a cutting blade 122. The blade 122 is pivotally mounted within the recess 120 by a pin 124 and is biased in a counter-clockwise direction against a stop (not shown) by a spring 126. To the left of the recess 120 is still another recess 128 for receiving an elongate spread roller 130 having a gear 132 mounted on one end thereof and a gear 134 mounted on the opposite end thereof. The spread roller 130 is adapted to be driven by a motor 136 through a gear train 138.

The processor 80 includes means for cooperating with the rails 60 and 62 on the second sheet 40 for preventing the processing liquid from leaking at the edges of the sheet 40 during the spreading of the liquid. Specifically, these means include a pair of laterally spaced ribs 140 and 142 which extend upwardly from the top wall 104. The ribs 140 and 142 are spaced from each other by a distance substantially equal to the width of the intermediate section 46 of the first sheet 38, and are adapted to receive therebetween a pair of ribs 144 and 146 extending downwardly from a plate 148 mounted in the second housing 84, as best seen in FIG. 3. The plate 148 is secured to the second housing 84 by a pair of screws 150 and 152 which extend through a pair of arms 154 and 156 extending outwardly from the plate 148. Each of the screws 150 and 152 is threaded only at its end section so as to enable the unthreaded portions to guide the plate in a vertical direction, as viewed in FIG. 5, under the influence of a spring 158.

As seen in FIG. 4, a pair of light emitting diodes 160 and 162 are mounted within the top wall 104. The diode 160 is located intermediate the ribs 140 and 142 while the diode 162 is located slightly out of alignment with the rib 140. A pair of diode detectors 164 and 166 are mounted within the housing 84 such that when the housings 82 and 84 are in the positions shown in FIG. 5 the detector 164 overlies the diode 160 and the detector 166 overlies the diode 162. The diodes 160 and 162 and their respective detectors 164 and 166 are incorporated into the processors electrical circuit (not shown) to insure proper operation of the processor 80 during operation thereof.

The end of the first housing 82 includes a recess 168 which cooperates with a recess 170 in the second housing 84 to define a chamber for receiving the film cassette 12. A leaf spring 172 is mounted within the recess 170 for maintaining the film cassette 12 in position during the processing of the composite film structure 14. Also, a plurality of wires 174 extend from the recess 168 into the recess 170 for electrically interconnecting the circuit components in the first housing 82 with those located within the second housing 84.

Figure 6:
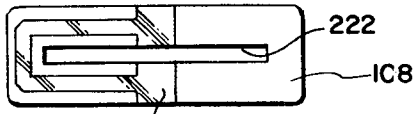
FIG. 6 is an end view of the dark chamber shown in FIG. 4.

The second housing 84 includes a recess 176 for receiving the top half of the flange 108 of the dark chamber 90. Mounted within the recess 176 is an electrical contact 178. When the flange 108 is located within the recesses 106 and 176, as shown in FIG. 5, the electrical contacts 110 and 178 are in engagement with a strip of electrically conductive material 180 located on the face of the flange 108, see FIG. 6, thereby forming a closed switch in the processor's circuit when it is connected with the batteries 98. The contacts 110 and 178 and the strip 180 function as a switch located in series connection with the motor 136 thereby insuring that the motor 136 cannot be electrically coupled to the batteries 98 by actuating a processing start button 182 unless the dark chamber is properly coupled to the first and second housing 82 and 84.

The cutting blade 122 is complemented by a second cutting blade 184 located within a recess 186 in the second housing 84. The blade 184 is pivotally coupled at 188 to the second housing 84 and is provided with a spring (not shown) for urging the blade 184 into the recess 186. A bell crank 190, see FIG. 5, is pivotally coupled to a flange 192 by a bolt 194. One leg 196 of the crank 190 extends to the exterior of the second housing 84 where it is provided with a manually actuatable handle 198. The other leg 200 of the crank 190 includes a section 202 which is located in engagement with the top surface of the free end of the cutting blade 184. As viewed in FIG. 5, movement of the handle 198 towards the viewer results in the section 202 moving the blade 184 into cutting relation with the blade 122 thereby severing the film located therebetween. As the second housing 84 is moving into closing relation with the first housing 82, the pivoted end 188 moves into engagement with an inclined surface on the terminal free end 204 of the blade 122. If the alignment of the blades 122 and 184 relative to each other is slightly off, the pivoted end 188 will engage the free end 204 to rotate it slightly against the bias of the spring 126.

The second housing 84 is provided with still another recess 206 for receiving a spread roller 208. The ends of the roller 208 are rotatably supported in a pair of T-shaped bearing blocks 210 and 212 for vertical movement, as viewed in FIG. 5, toward and away from the spread roller 130. A spring strap 214 is mounted intermediate its arms within the recess 206 such that each of its arms (only one being shown in FIG. 5) 216 bear against the bearing blocks 210 and 212 to urge them into engagment with a narrowed portion 218 at the lower end of the recess 206. A gear 220 is secured to one end of the spread roller 208 whereby the rotation of the spread roller 130 is transferred to the spread roller 208 via the gears 134 and 220.

Prior to processing the exposed intermediate section 46 of the film assemblage 10, the dark chamber 90 is removed from the elongate recess 88 and extended to its fullest extent, approximately 54 centimeters. The dark chamber 90 is then attached to the first housing 82 by inserting the lower half of the flange 108 into the recess 106. The container of processing liquid 22 is removed from the film cassette 12 and the latter is then placed in the recess 168 and the composite film structure 14 laid along the top surface 104 of the first housing 82 such that the second end 42 of the assemblage 14 extends into the dark chamber 90 via opening 222 and the intermediate portion 46 of the first sheet 38 and the superposed second sheet 40 are located between the rails 140 and 142 with the aperture 64 located to the left of the spread roller 130 and the opaque rail 60 overlies the diode 162. The container of processing liquid 22 is threaded through the aperture 64 such that it overlies the diode 160 and its discharge end 36 is facing the film cassette 12. The container 22 is maintained in place by the contact between the top surface of the second sheet 40 and the adhesive strips 32 on the member 30. The second housing 84 is then moved into the position shown in FIG. 5 thereby enclosing the film assemblage 10 in a light free environment. A normally open electrical switch 224 located in series with the motor 136 is provided for insuring that the motor 136 cannot be started until after the switch 224 is closed by the pin 118 moving a contact 226 into engagement with a contact 228 during the proper latching of the first and second housing 82 and 84 in the closed position. As described previously, the contacts 110 and 178 and the strip of electrically conductive material 180 also function as a closed switch located in series with the switch 224 and with the motor when located in the position shown in FIG. 5. Further, the detector 166 functions to open a normally closed switch located in series with the above two switches and with the motor 136 when the illumination of its respective LED 162 strikes it; while the detector 164 functions to latch a switch, located in series with the other switches, in a closed position if it does not see the initial illumination of the LED 160. This latter switch remains latched in a closed position until the timing circuit ends. Next, the button 182 is depressed to initiate a processing cycle. Depression of the button 182 normally results in a timing circuit being energized, the diodes 160 and 162 being illuminated, and the motor 16 being electrically coupled to the batteries 98 thereby driving the spread roller 130 in a clockwise manner. However, if certain conditions are not met, the motor 138 will not be connected to the batteries 98. These conditions are: (1) the two housings 82 and 84 must be securely latched in the closed position thereby closing the normally open switch 224; (2) the dark chamber 90 must be in position thereby closing the switch comprised of contacts 110 and 178 and the electrically conductive strip 180, which switch is in series with the motor 136; (3) the container 22 of processing liquid must be located between the diode 160 and the detector 164 such that when the diode 160 is illuminated by the depression of the button 182, its illumination does not strike the detector 164; and (4) the opaque rail 60 is located over the diode 162 thereby preventing its illumination from striking the receptor 166. With all of the above four conditions met, the motor 136 is energized to drive the spread rollers 130 and 208 to drive the composite film structure 14 to the right into the dark chamber 90. Initial movement of the composite film structure 14 moves the container 22 into the bite of the rollers 130 and 208 which, in turn, apply a pressure to the container 22 to rupture its end 36. The rollers 130 and 208 spread the contents of the container between the first and second sheets 38 and 40 so as to initiate the formation of visible images within the first sheet 38 while simultaneously advancing the liquid treated portions into the dark chamber 90. The length of the opaque rail 60 is selected such that its end moves out from between the diode 162 and its detector 166 just subsequent to the trailing end of the intermediate portion 46 passing through the rollers 130 and 208. When the end of the opaque rail 60 moves out of covering relation with the diode 162, the illumination of the diode 162 strikes the detector 166 which, in turn, opens its associated switch thereby disconnecting the motor 136 from the batteries 98. The liquid treated composite film structure 14 remains within the light free environment of the processor 80 and the dark chamber 90 until the aforementioned timing circuit ends, as indicated by a bulb 230 turning off. At this time, the processing liquid has imbibed the first sheet 38 for a period of time sufficient to enable it to be exposed to the ambient light without fear of it being adversely fogged or further photographically exposed. Further, the processing liquid has dried to the extent that it forms a permanent bond between the first and second sheets 38 and 40, respectively. The handle 198 may now be actuated to pivot the blade 184 downwardly thereby severing the intermediate portion 46 and the superposed second sheet 40 from the remainder of the composite film structure 14. The severed portion of the composite film structure 14 containing the visible images may now be removed from the processor 80 and the dark chamber 90 and the individual images severed and mounted for subsequent viewing.

Since certain changes may be made in the above described invention without departing from the scope thereof, it is intended that all matters contained in the above description or shown in the accompanying drawings shall be interpreted as illustrative and not in a limiting sense.

What is claimed is:

1. Apparatus for processing a composite roll of self-developing transparency film comprising:

first and second housings coupled to each other for movement between a film cassette loading position and a film processing position;

means within said first housing for supporting a film cassette containing a composite roll of self-developing transparency film including first and second opposite ends and a given length of film extending between and containing a plurality of discrete, latent, subject images recorded thereon;

a lighttight chamber connectable with said first and second housings for receiving the second end of the film;

a pair of elongate rollers adapted to be located on opposite sides of the film when said first and second housings are in said film processing position;

a motor;

drive means coupled to said motor and to one of said rollers to thereby enable said motor, when energized, to rotate said one roller so as to advance the film from the film cassette and into the lighttight chamber while simultaneously spreading a processing liquid across the given length of the film to initiate the transformation of the discrete latent images into visible images;

means for automatically disconnecting said motor from its source of energy when a container of processing liquid is not located within said apparatus in position to be spread across the transparency film by said rollers; and means for automatically disconnecting said motor from its source of energy after the end of the given length of film located closest to the first end of the film has moved through said rollers.

2. Apparatus for processing a composite roll of self-developing transparency film comprising:

first and second housings coupled to each other for movement between a film cassette loading position and a film processing position;

means within said first housing for supporting a film cassette containing a composite roll of self-developing transparency film including first and second opposite ends and a given length of film extending therebetween and containing a plurality of discrete, latent, subject images recorded thereon;

a pair of elongate rollers adapted to be located on opposite sides of the film when said first and second housings are in said film processing position;

a motor;

a lighttight chamber connectable with said first and second housings for receiving the second end of the film, said lighttight chamber including means for completing an electrical switch located in series with said motor when located in lighttight relation with said first and second housings, whereby said motor cannot be energized when said lighttight chamber is not located in lighttight relation with said first and second housings;

drive means coupled to said motor and to one of said rollers to thereby enable said motor, when energized, to rotate said one roller so as to advance the film from the film cassette and into the lighttight chamber while simultaneously spreading a processing liquid across the given length of the film to initiate the transformation of the discrete latent images into visible images; and means for automatically disconnecting said motor from its source of energy after the end of the given length of film located closest to the first end of the film has moved through said rollers.

3. Apparatus for processing a composite roll of self-developing transparency film comprising:

first and second housings coupled to each other for movement between a film cassette loading position and a film processing position;

means within said first housing for supporing a film cassette containing a composite roll of self-developing transparency film including first and second opposite ends and a given length of film extending therebetween and containing a plurality of discrete, latent, subject images recorded thereon;

a lighttight chamber connectable with said first and second housings for receiving the second end of the film;

a pair of elongate rollers adapted to be located on opposite sides of the film when said first and second housings are in said film processing position;

a motor;

drive means coupled to said motor and to one of said rollers to thereby enable said motor, when energized, to rotate said one roller so as to advance the film from the film cassette and into the lighttight chamber while simultaneously spreading a processing liquid across the given length of the film to initiate the transformation of the discrete latent images into visible images;

means for automatically disconnecting said motor from its source of energy after the end of the given length of film located closest to the first end of the film has moved through said rollers; and said first and second housing each further including an electrical contact which forms part of a switch located in series with said motor, and said lighttight chamber includes an electrically conductive element for completing said switch, said element being constructed so as to engage said electrical contacts only when located in lighttight relation with said first and second housings.

4. The apparatus as defined in claim 3 wherein said lighttight chamber includes a plurality of linearly extendable housings sections telescopically nested within each other.

5. The apparatus as defined in claim 4 wherein said first housing includes means for storing said lighttight housing.

6. Apparatus for processing a composite roll of self-developing transparency film comprising:

first and second housings coupled to each other for movement between a film cassette loading position and a film processing position;

means within the first housing for supporting a film cassette containing a composite roll of self-developing transparency film including first and second opposite ends and a given length of film extending therebetween and containing a plurality of discrete, latent, subject images recorded thereon;

a lighttight chamber connectable with said first and second housings for receiving the second end of the film;

a pair of elongate rollers adapted to be located on opposite sides of the film when said first and second housings are in said film processing position;

a motor;

drive means coupled to said motor and to one of said rollers to thereby enable said motor, when energized, to rotate said one roller so as to advance the film from the film cassette and into the lighttight chamber while simultaneously spreading a processing liquid across the given length of the film to initiate the transformation of the discrete latent images into visible images;

means for automatically disconnecting said motor from its source of energy after the end of the given length of film located closest to the first end of the film has moved through said rollers;

said apparatus further including a first cutting blade having means at one end thereof for pivotally connecting said first blade to said first housing and an inclined camming surface at its opposite end, a second cutting blade pivotally mounted within said second housing for movement in a plane perpendicular to the plane of movement of said first blade, said second blade including a surface movable into engagement with said inclined camming surface as said first and second housings assume said film processing position so as to maintain a predetermined relationship between said first and second blades during severing of the film; and means for resiliently biasing said first blade into engagement with said second blade.

* * * * *